US007081027B2

(12) United States Patent
Woodward

(10) Patent No.: US 7,081,027 B2
(45) Date of Patent: Jul. 25, 2006

(54) COMPRESSION MULTI-TAP 360 DEGREE ROTATING CONNECT/DISCONNECT TERMINAL

(75) Inventor: Jerry Allen Woodward, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/060,051

(22) Filed: Feb. 17, 2005

(65) Prior Publication Data

US 2005/0191895 A1 Sep. 1, 2005

Related U.S. Application Data

(60) Provisional application No. 60/548,752, filed on Feb. 27, 2004.

(51) Int. Cl.
*H01R 11/01* (2006.01)

(52) U.S. Cl. ..... 439/777; 439/794; 174/86

(58) Field of Classification Search ..... 439/777, 439/794, 713, 797–798, 13, 883, 418; 174/86, 174/84 C See application file for complete search history.

(56) References Cited

U.S. PATENT DOCUMENTS

| | | | | |
|---|---|---|---|---|
| 2,597,286 | A * | 5/1952 | Burgess | 439/723 |
| 3,171,888 | A | 3/1965 | Stanback | 174/72 B |
| 3,891,298 | A | 6/1975 | Yorgin et al. | 439/620 |
| 4,077,697 | A * | 3/1978 | Yates | 439/711 |
| 4,552,430 | A | 11/1985 | Myers | 439/786 |
| 4,603,376 | A | 7/1986 | Maier | 361/824 |
| 4,751,049 | A | 6/1988 | Shannon | 420/477 |
| 4,809,132 | A | 2/1989 | Palmieri | 361/634 |
| 5,005,104 | A | 4/1991 | Grunert et al. | 361/637 |
| 5,036,164 | A | 7/1991 | Schrader et al. | 174/94 R |
| 5,107,396 | A | 4/1992 | Rosen et al. | 361/637 |
| 5,928,006 | A | 7/1999 | Franks, Jr. | 439/92 |
| 5,931,708 | A * | 8/1999 | Annas et al. | 439/798 |
| 6,547,585 | B1 | 4/2003 | Bradley et al. | 439/535 |
| 6,579,131 | B1 * | 6/2003 | Ashcraft et al. | 439/798 |
| 6,857,900 | B1 | 2/2005 | Kleeberger et al. | 439/540.1 |

* cited by examiner

*Primary Examiner*—Michael C. Zarroli
(74) *Attorney, Agent, or Firm*—Hoffmann & Baron, LLP

(57) ABSTRACT

A multi-tap electrical connector assembly that includes a plurality of connectors having a body with an aperture extending therethrough and either a male pin or a compression fitting and an elongated metal rod having a longitudinal axis. The metal rod is inserted through the apertures and electrically contacts the connectors to form an electrically conductive path from the metal rod to the male pins or the compression fittings. The connectors can rotate 360 degrees around the longitudinal axis of the metal rod while maintaining electrical conductivity between the rod and connectors and the male pins and compression fittings can be connected to wires or cables from #8 AWG to 3000 kcmil in size.

14 Claims, 4 Drawing Sheets

COMPRESSION MULTI-TAP 360 DEGREE ROTATING CONNECT/DISCONNECT TERMINAL

This application claims priority from provisional application Ser. No. 60/548,752, filed on Feb. 27, 2004.

BACKGROUND OF INVENTION

The present invention is a modular multi-tap electrical connector assembly for quick connection and disconnection of a plurality of wires/cables. In particular, the present invention relates to a modular multi-tap electrical connector assembly that can be used for quick connection and disconnection of a plurality of different size wires/cables in a limited space.

Many wiring applications require numerous connections to be made in a relatively limited amount of space. A wide variety of terminal blocks and connectors have been developed for such applications and they are very useful for small gauge wires. However, larger gauge wires and cables require more space and present a variety of problems in applications where the space is limited. One of the problems is that larger wires and cables have larger bend radii which makes it difficult when they have to bent in order to connect them to a terminal.

Most of the connectors now in use make a straight line connection between the electrical wire/cable and the electrical device to which they are terminated. However, for some applications, a straight line connection cannot be used and the wire/cable needs to be introduced at some angle (typically up to 90°) to the electrical device. Quite often, the wires/cables are bent in order to make such a connection. Bending large diameter wires/cable in this manner may cause the insulation around the wire/cable to crack or break which can lead to problems due to insufficient insulation covering the cable.

One solution to this problem is to cast a right angle (or any other desired angle) connector for making such transition in the connector itself. However, this requires an individually cast part to be formed for each specific application. Another solution uses right angle electrical contacts in electrical connector housings to make right angle transitions. Such contacts are disclosed in U.S. Pat. Nos. 4,050,769 and 4,080,041. Right angle contacts of this type may also be used for individually coupling closely grouped cable terminations as disclosed in U.S. Pat. No. 4,552,430. Terminations of this type include a cable connection portion at one end and a termination portion at the other end and an elongate metal rod connecting the two ends. The rod can be constructed so that the cable connection end and the termination end are disposed at a right angle. The electrical terminal described in the '430 patent requires a complex connection device which attaches to one end of the metal rod for connecting the electrical cable. This arrangement is costly due in part to the additional number of components and the more complex design.

Users of electrical terminals for large size wires/cables have applications where it is necessary to connect several different size wires/cables in a limited space and it is not practical to use a conventional terminal block. Various attempts have been made to solve this problem, but for the most part they have been unsatisfactory. Accordingly, there is a need for a connector that can be used to quickly and easily connect a plurality of large wires/cables in a limited space.

SUMMARY OF THE INVENTION

The present invention relates to a multi-tap electrical connector assembly that includes a first connector having a body with an aperture extending therethrough and a first male pin or a first compression fitting and an elongated metal rod having a longitudinal axis. The metal rod passes through the aperture and electrically contacts the body to form an electrically conductive path from the metal rod to the first male pin or the first compression fitting. The first connector can rotate 360 degrees around the longitudinal axis of the metal rod while maintaining electrical conductivity between the rod and connector. The first compression fitting can have a variety sizes and connects to wires or cables from #8 AWG to 3000 kcmil in size.

The multi-tap electrical connector assembly can also include a second connector. The first and second connectors are electrically contacted to the metal rod and also, preferably, to each other. The first and second connectors independently rotate 360 degrees around the longitudinal axis of the metal rod. The first connector has a first male pin or a first compression fitting having a first size and the second connector has a second male pin or a second compression fitting having a second size. The first and second sizes can be the same or they can be different.

In one preferred embodiment, the multi-tap electrical connector assembly includes a plurality of connectors, wherein each connector includes a body having an aperture extending therethrough and a male pin or a compression fitting, and an elongated metal rod having a longitudinal axis. The metal rod passes through the aperture in each of the plurality of connectors and electrically contacts each of the plurality of connectors to form an electrically conductive path between the metal rod and the first male pin or the first compression fitting of each of the plurality of connectors. Each of the plurality of connectors can be independently rotated 360 degrees around the longitudinal axis of the metal rod while maintaining electrical conductivity between the rod and connectors. The plurality of connectors are in electrical contact with the rod and they can also be in contact mechanically, as well as electrically, with an adjacent connector. The male pin or the compression fitting for each of the plurality of connectors can be the same size or the sizes can be different.

In preferred embodiments, the apertures in the connectors and/or the compression fittings have a beryllium contact ring for increased electrical conductivity. In other preferred embodiments, the body is at least partially coated with electrically insulating material.

The present invention also includes a kit of parts for a multi-tap electrical connector assembly which includes: an elongated metal rod having a longitudinal axis and a plurality of connectors each having a metal body with an aperture and a male pin or a compression fitting. The apertures of each of the connectors are adapted to insertably accommodate the metal rod for mechanical and electrical engagement between the metal rod and the connectors. After the metal rod is inserted in the apertures, the connectors can be independently rotated 360 degrees around the longitudinal axis of the metal rod.

BRIEF DESCRIPTION OF THE FIGURES

Other objects and many attendant features of this invention will be readily appreciated as the invention becomes better understood by reference to the following detailed description when considered in connection with the accompanying drawings wherein.

DETAILED DESCRIPTION OF THE INVENTION

Figure 1:
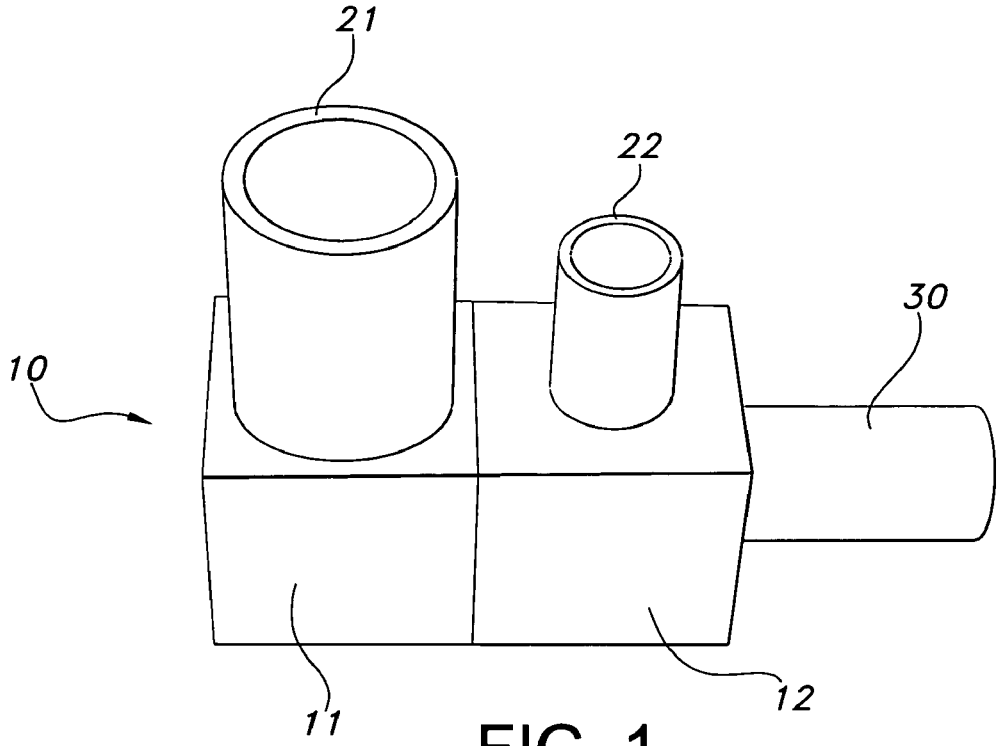
FIG. 1 shows two connectors connected to a metal rod to form a multi-tap electrical connector assembly.

The present invention is a modular multi-tap electrical connector assembly that provides easy and efficient connection for a plurality of wires/cables of the same or different sizes. The modular multi-tap electrical connector assembly is formed by connecting two or more connectors to each other using a metal rod that passes through the body of each of the connectors. The multi-tap electrical connector assemblies have at least two connectors that are in electrical contact with the metal rod and each other. Each of the connectors has an aperture in the central portion of the connector which is sized to rotatably and frictionally engage the metal rod that is inserted into the aperture while maintaining electrical conductivity between the rod and connectors. The metal rod electrically connects all of the connectors in the assembly.

Electrical connectors of the type described herein include either a male pin or a tubular end portion commonly referred to as a barrel connector or compression fitting, which extend outwardly from the connector. The barrel connector is placed over the stripped end of a solid or stranded electrical wire/cable and then crimped or otherwise mechanically and electrically secured to the stripped end of the wire/cable. The other end of the wire/cable can have a wide variety of connectors with shapes and sizes for effecting different terminations.

The size of the apertures in the connectors and the corresponding size of the diameter of the metal rod depend on the particular application. One of ordinary skill in the art will appreciate that applications for larger wires/cables which carry higher loads require larger connectors and metal rods. The connectors can also have different size connections so that wires/cables of different sizes can be accommodated. The accompanying figures show that the connectors have compression fittings for connecting wires/cables. However, the connectors can also have male pin connections. In the embodiments shown in the figures, the compression fittings and male pin connections that are used on the connectors can be used to terminate incoming wires/cables from #8 AWG to 3000 kcmil in size. In a preferred embodiment, the compression fittings are provided with multi-louvered beryllium contact rings at the contact interface.

In preferred embodiments, the metal rod frictionally engages two or more of the multi-tap connectors to form a modular connector assembly. The rod is inserted into the apertures in the connectors and mechanically as well as electrically engages the connectors. The rod is constructed of a conductive metal (such as copper) which is, preferably, the same metal as the multi-tap connectors, so that all the connectors in the modular connector assembly are electrically connected. The metal rod can then be connected to an electrical grid by either an electrical bus, a grounding bus or a cable.

The length of the rod can vary depending on the application with such factors as the number of multi-tap connectors in the modular connector assembly and the installation requirements of particular importance. For the expansion of existing modular connector systems, a second rod can be inserted into a multi-tap connector on the end of a modular connector assembly. In a preferred embodiment, the connector used for joining two metal rods is wider than a typical connector in order to provide additional mechanical strength. In a most preferred embodiment, the connector includes two retention screws which pass through the body of the connector and engage the rod to secure the connector in place. The second metal rod allows additional multi-tap connectors to be added to the multi-tap connector assembly.

Once the modular connectors and metal rod are assembled, the outer surfaces of the connectors can be insulated with a suitable electrical insulation to prevent short circuits and grounding. In a preferred embodiment, thermal plastic clam shell insulating boots are placed on the connectors. The individual connectors can also be dipped in a thermal insulating material such as PVC.

The connectors that are used in the modular multi-tap electrical connector assembly of the present invention are constructed of an electrically conductive metal such as copper or aluminum and can be plated with a material known by those skilled in the art for plating electrical devices, such as tin. The connectors are preferably shaped like a block but the connectors are not limited to a particular shape. Typically, the block-shaped connectors have six surfaces with the central aperture passing through two opposing surfaces. A male pin or compression fitting connection extends outwardly from one of the remaining four surfaces of the connector. In some embodiments, a connector can have a male pin or compression fitting connection on each of the four surfaces.

FIG. 1 shows a modular multi-tap electrical connector assembly 10 with two connectors 11 and 12 that are connected to each other with a metal rod 30. Each of the connectors 11 and 12 has a compression fitting 21, 22 that extends outwardly and is oriented approximately 90 degrees from the axis of the metal rod 30. The first connector 11 has a compression fitting 21 for a larger size wire/cable and the second multi-tap connector 12 has a compression fitting 22 for a smaller size wire/cable. The modular multi-tap electrical connector assemblies of the present invention can be formed from a plurality of different connectors having different configurations and different connection sizes. The connectors 11, 12 can be independently rotated on the rod 30 while maintaining electrical conductivity with the rod 30.

Figure 2:
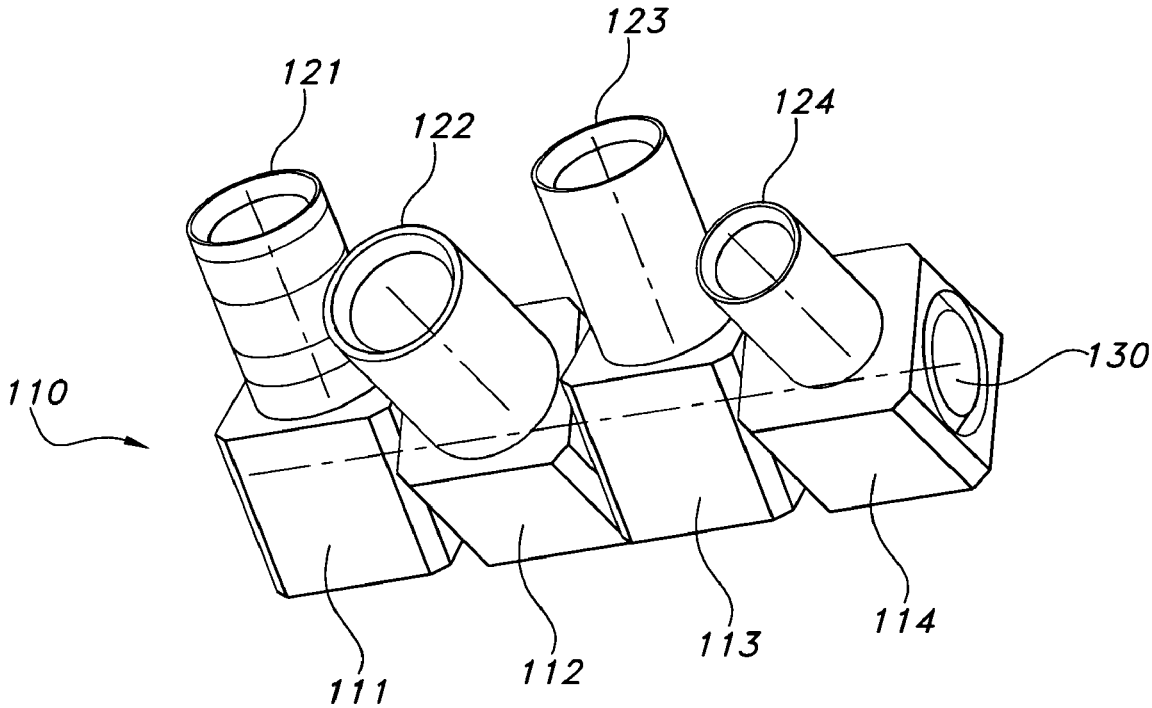
FIG. 2 shows four connectors connected to a metal rod to form a multi-tap electrical connector assembly.

As shown in FIG. 2, the connectors 111, 112, 113, 114 can be rotated about the axis of the metal rod 130 to provide different orientations for the wires/cables connected to the modular multi-tap electrical connector assembly 110. This permits the compression fittings 121, 122, 123, 124 to be rotated to receive wires entering the modular multi-tap electrical connector assembly 110 over a 360 degree range while maintaining electrical conductivity between the rod and connectors. A particular advantage of this design is that, when a wire/cable is installed in one of the compression fittings (for example compression fitting 123 in connector 113), the connectors on either side (connectors 112, 114) can be rotated out of the way in order to provide easy access to compression fitting 123. This allows a user to easily and quickly crimp the compression fitting 123 around a wire/cable (not shown) using a standard crimping tool.

The rod 130 for the modular connector assembly 110 shown in FIG. 2 extends substantially all the way through the connectors 111–114. This provides for mechanical as well as electrical connectivity between the metal rod 130 and the connectors 111–114. In a typical application, the rod 130 extends beyond the end connectors (111, 10.14) and is connected to an electrical bus, a ground bus or a cable (not shown). The connectors 111–114 in FIG. 2 have a substantially cube-shape with rounded edges. However, the connectors of the present invention are not limited to a cubic shape and may have different shapes with multiple surfaces or may have a cylindrical outer surface that is concentric with the metal rod 130.

Figure 3:
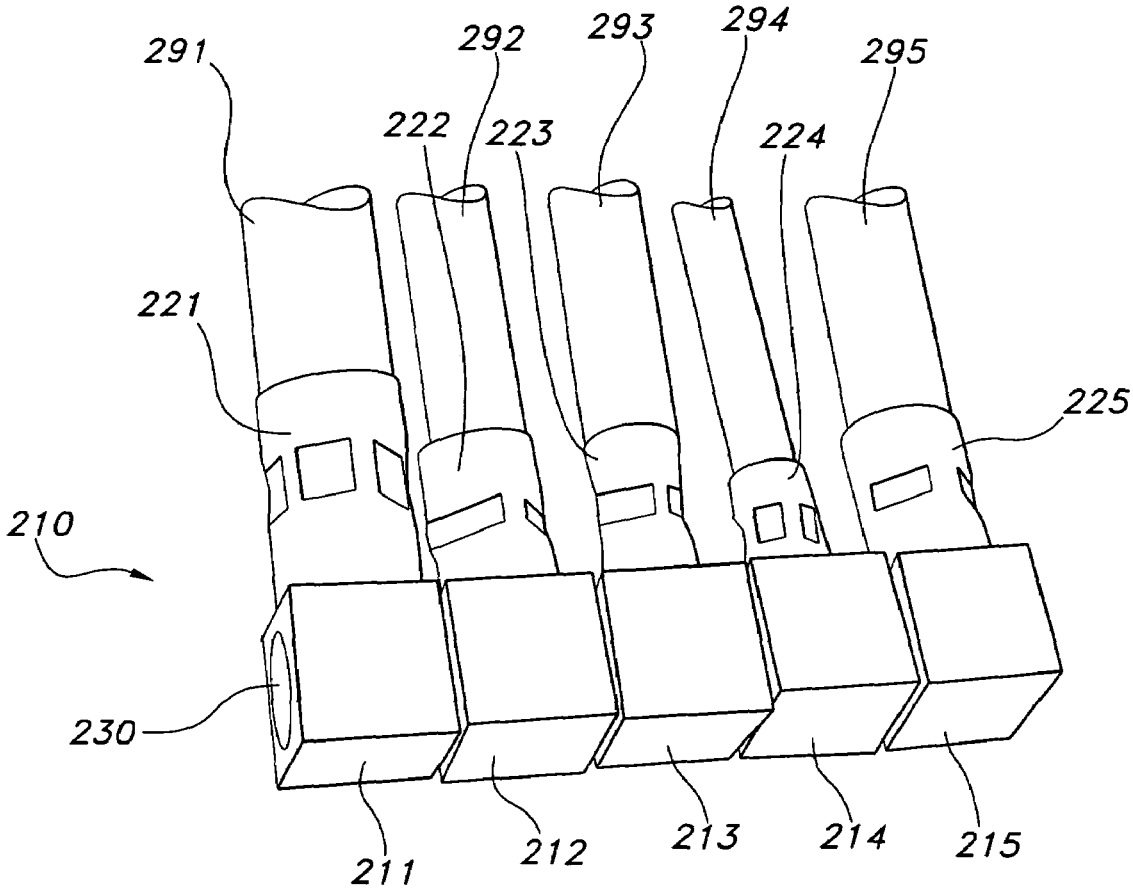
FIG. 3 shows a multi-tap electrical connector assembly with five connectors connected to different size wires.

FIG. 3 shows a modular multi-tap electrical connector assembly 210 having five connectors 211–215 with different size compression fittings 221–225 for connecting to different size wires/cables 291–295. The connectors 211–215 are mechanically and electrically connected by the metal rod 230. The configuration of the multi-tap electrical connector assembly 210 allows multiple connections to be made in a relatively limited amount of space.

Figure 4:
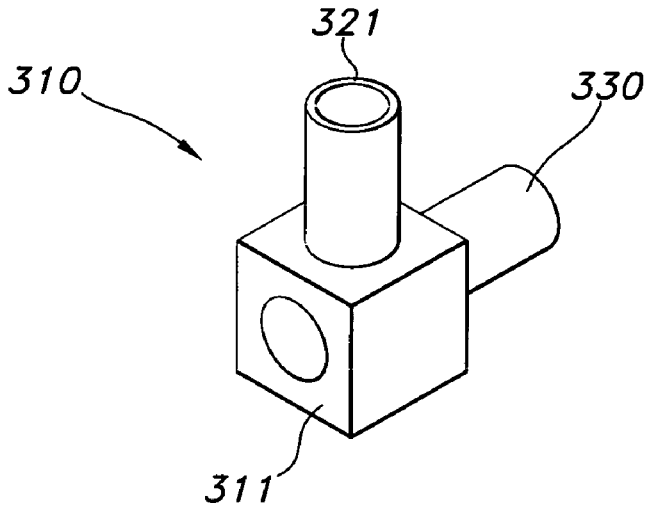
FIG. 4 shows a multi-tap electrical connector assembly with one connector on the metal rod.
Figure 5:
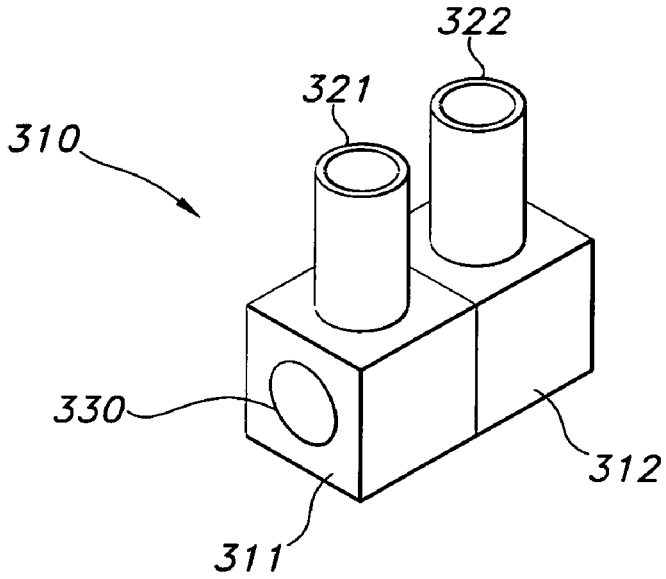
FIG. 5 shows the multi-tap electrical connector assembly of FIG. 4 with two connectors on the metal rod.
Figure 6:
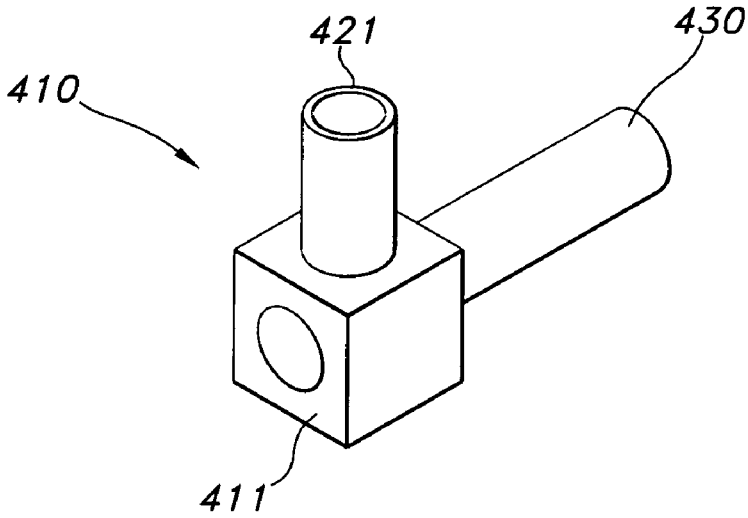
FIG. 6 shows a multi-tap electrical connector assembly with one connector on the metal rod.
Figure 7:
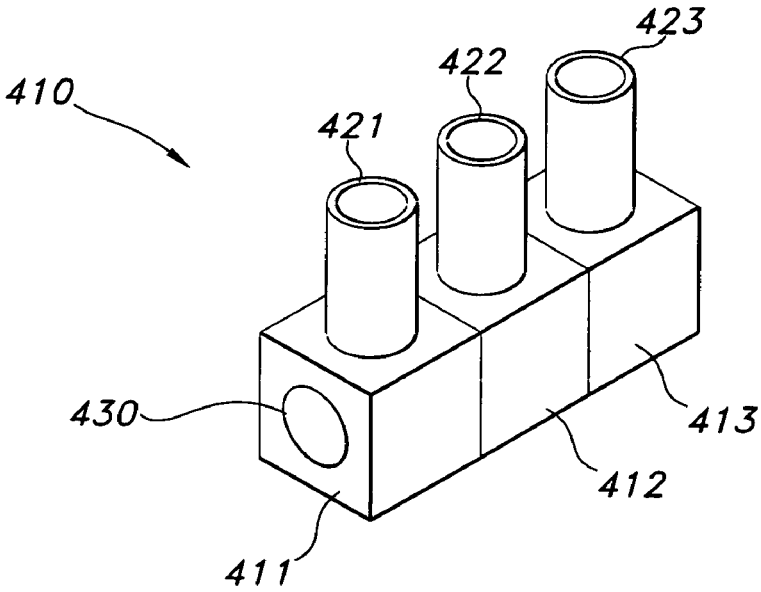
FIG. 7 shows the multi-tap electrical connector assembly of FIG. 6 with three connectors on the metal rod.
Figure 8:
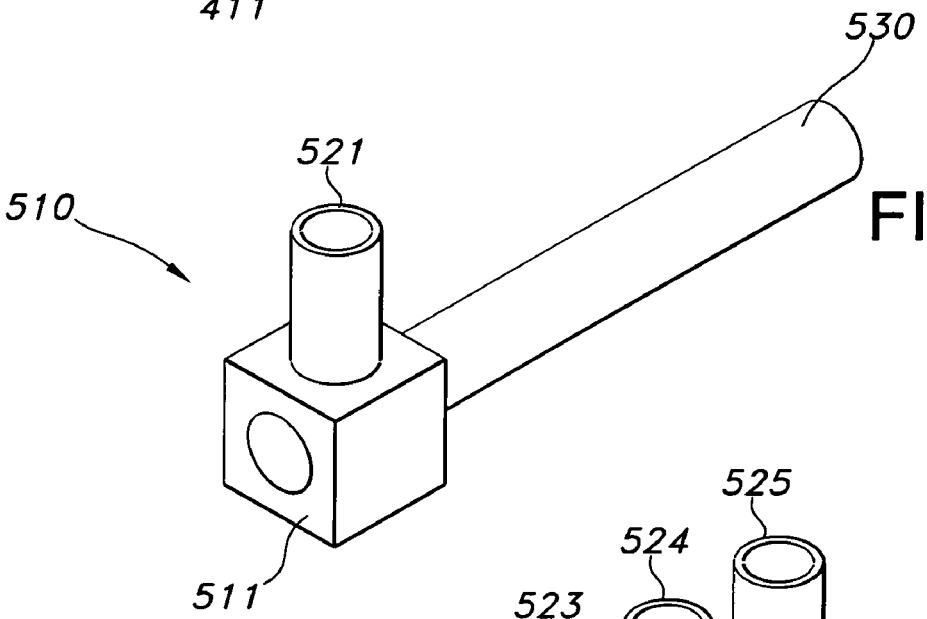
FIG. 8 shows a multi-tap electrical connector assembly with one connector on the metal rod.
Figure 9:
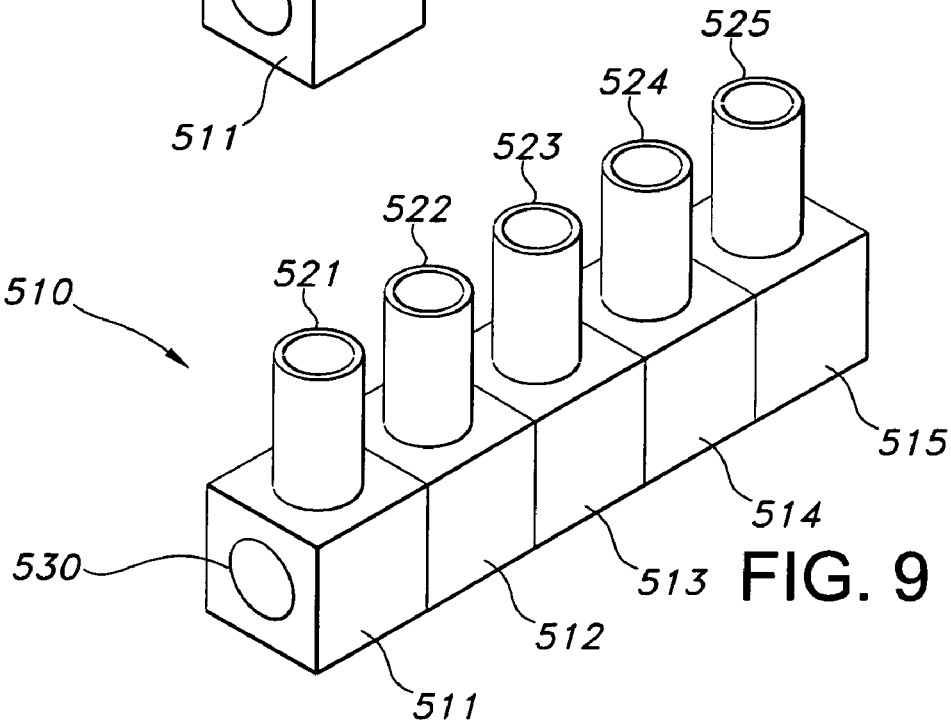
FIG. 9 shows the multi-tap electrical connector assembly of FIG. 8 with five connectors on the metal rod.

FIGS. 4, 6 and 8 show multi-tap electrical connector assemblies 310, 410, 510 that include metal rods 330, 430, 530 extending through the connectors 311, 411, 511 to provide mechanical and electrical connectivity. The metal rods 330, 430, 530 are connected to an electrical bus or a ground bus (not shown) and provide an electrically conductive path between the electrical/ground bus and the compression fittings 321, 421, 521 on the connectors 311, 411, 511. The metal rods 330, 430, 530 extend outwardly from the connectors 311, 411, 511 and additional connectors 312, 412–413, 512–515 (shown in FIGS. 5, 7, and 9) can be inserted onto the metal rods 330, 430, 530 to accommodate the connection of additional wires/cables via compression fittings 322, 422–423, 522–525 (FIGS. 5, 7, and 9). The length of the rod 330, 430, 530 can vary to accommodate as many connectors as may be required for a particular application. It should also be noted that connector assemblies 310, 410, 510 described above may employ male pins in lieu of the compression fittings described.

A user can also add connectors to the modular multi-tap electrical connector assembly 310, 410, 510 at a later date by selecting a longer metal rod 330, 430, 530 (see FIGS. 4, 6 and 8) then is required for the initial installation. This allows additional connectors 311–312, 411–413, 511–515 (FIGS. 5, 7, 9) to be added at any time. This provides flexibility and easy reconfiguration of the multi-tap electrical connector assembly.

Thus, while there have been described the preferred embodiments of the present invention, those skilled in the art will realize that other embodiments can be made without departing from the spirit of the invention, and it is intended to include all such further modifications and changes as come within the true scope of the disclosure set forth herein.

We claim:

1. A multi-tap electrical connector assembly comprising:

a first connector comprising a body having an aperture extending therethrough and a first male pin or a first compression fitting; and an elongated metal rod having a longitudinal axis;

wherein the metal rod passes through the aperture and electrically contacts the body to form an electrically conductive path from the metal rod to the first male pin or the first compression fitting, and wherein the first connector can rotate 360 degrees around the longitudinal axis while maintaining electrical conductivity between the rod and connector.

2. The multi-tap electrical connector assembly according to claim 1, wherein the first compression fitting connects to wires or cables from #8 AWG to 3000 kcmil in size.

3. The multi-tap electrical connector assembly according to claim 1, further comprising a second connector, wherein the first and second connectors are electrically contacted to the metal rod and to each other, and wherein the first and second connectors independently rotate 360 degrees around the longitudinal axis of the metal rod.

4. The multi-tap electrical connector assembly according to claim 3, wherein the first connector has a first compression fitting having a first size and the second connector has a second compression fitting having a second size, and wherein the first and second sizes need not be the same.

5. The multi-tap electrical connector assembly according to claim 1, wherein the body comprises a beryllium contact ring.

6. The multi-tap electrical connector assembly according to claim 1, wherein the body is at least partially coated with electrically insulating material.

7. A multi-tap electrical connector assembly comprising:

a plurality of connectors, wherein each connector comprises a body having an aperture extending therethrough and a male pin or a compression fitting; and an elongated metal rod having a longitudinal axis;

wherein the metal rod passes through the aperture in each of the plurality of connectors and electrically contacts each of the plurality of connectors to form an electrically conductive path between the metal rod and the first male pin or the first compression fitting of each of the plurality of connectors.

8. The multi-tap electrical connector assembly according to claim 7, wherein each of the plurality of connectors can be independently rotated 360 degrees around the longitudinal axis of the metal rod while maintaining electrical conductivity between the rod and connectors.

9. The multi-tap electrical connector assembly according to claim 7, wherein the plurality of connectors are in electrical contact with the rod and with each other.

10. The multi-tap electrical connector assembly according to claim 7, wherein the male pin or the compression fitting for each of the plurality of connectors can be the same size or the sizes can be different.

11. The multi-tap electrical connector assembly according to claim 7, wherein each of the bodies of the plurality of connectors comprises a beryllium contact ring.

12. The multi-tap electrical connector assembly according to claim 7, wherein each of the bodies of the plurality of connectors is at least partially coated with electrically insulating material.

13. A multi-tap electrical connector assembly comprising:

a connector comprising a body having an aperture extending therethrough and a compression fitting comprising a beryllium contact ring; and an elongated metal rod having a longitudinal axis;

wherein the connector is adapted to insertably accommodate the metal rod for mechanical and electrical engagement between the metal rod and the connector, wherein the first compression fitting connects to wires or cables from #8 AWG to 3000 kcmil in size, and wherein the connector can be rotated 360 degrees around the longitudinal axis of the metal rod while maintaining electrical conductivity between the rod and connector, wherein the aperture of the connector is adapted to insertably accommodate the metal rod.

14. A kit of parts for a multi-tap electrical connector assembly comprising:

an elongated metal rod having a longitudinal axis; and a plurality of connectors each comprising a metal body having an aperture extending therethrough and a male pin or a compression fitting, wherein each of the connectors is adapted to insertably accommodate the metal rod for mechanical and electrical engagement between the metal rod and the connectors, and wherein the connectors can be independently rotated 360 degrees around the longitudinal axis of the metal rod while maintaining electrical conductivity between the rod and connectors.

* * * * *